US007780484B2

(12) United States Patent
Martin

(10) Patent No.: US 7,780,484 B2
(45) Date of Patent: Aug. 24, 2010

(54) ELECTRICAL CONNECTOR HAVING ALTERNATIVE INNER HOUSINGS

(75) Inventor: Galen M Martin, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 38 days.

(21) Appl. No.: 12/157,885

(22) Filed: Jun. 13, 2008

(65) Prior Publication Data

US 2009/0311918 A1 Dec. 17, 2009

(51) Int. Cl.
*H01R 13/514* (2006.01)

(52) U.S. Cl. ..... 439/752

(58) Field of Classification Search ..... 439/701, 439/752, 686

See application file for complete search history.

(56) References Cited

U.S. PATENT DOCUMENTS

| | | | | |
|---|---|---|---|---|
| 5,266,056 | A | 11/1993 | Baderschneider et al. | |
| 5,997,359 | A * | 12/1999 | Picaud et al. | 439/686 |
| 6,030,256 | A * | 2/2000 | Cappe | 439/598 |
| 6,547,605 | B2 * | 4/2003 | Daugherty et al. | 439/686 |
| 6,832,937 | B1 * | 12/2004 | Wrede et al. | 439/752 |
| 7,044,808 | B1 | 5/2006 | Foltz et al. | |

* cited by examiner

*Primary Examiner*—Tho D Ta

(57) ABSTRACT

An outer housing is configured to receive alternative first and second housings. The first inner housing is configured to receive clean body contacts where the inner housing includes integral locking latches extending into the contract receiving cavity where the locking latch may be positioned against the shoulder of the contract retaining the contact in position in the cavity. Alternatively, a second inner housing may be provided with a locking shoulder against which a locking lance of an electrical contact having a locking lance may be provided.

18 Claims, 7 Drawing Sheets

ELECTRICAL CONNECTOR HAVING ALTERNATIVE INNER HOUSINGS

FIELD OF THE INVENTION

This application relates generally to electrical connector assemblies having inner and outer housings.

BACKGROUND OF THE INVENTION

Multiple connector assemblies exist which include an outer housing provided with a mating configuration for mating with another connector, where the mating configuration may include means for aligning the connector assembly with the mating connector as well as latching of the connector assembly to the mating connector. Such electrical connector assemblies may also include an inner housing which is received within the outer housing where the inner housing has the capability of receiving a plurality of electrical contacts.

It is also known to provide a plurality of locking arrangements of terminals within connector housings such as the inner housing referenced above. Such contact locking arrangements may include a locking lance, which is normally defined by a rearwardly extending portion of the electrical terminal, which is stamped free of the remainder of the contact body which deflects upon entry into the housing and resiliently biases back to a position for locking. These contacts are normally referred to as locking lance-style electrical contacts, an example is shown in our U.S. Pat. No. 5,266,056, the contents of which are incorporated herein by reference.

Another style of contact contains no locking lance but rather contains a shoulder, normally rearwardly facing, which is retained within a housing, such as the inner housing referenced above by way of resilient locking latch extending integrally from the housing into a contact receiving cavity. These types of electrical contacts are normally referred to as "clean body" contacts and one is shown, for example, in our U.S. Pat. No. 7,044,808, the entirety of which is incorporated herein by reference.

Given the availability of multiple styles of electrical contacts, it would be desirable to provide a connector system where at least some of the components are universal and/or interchangeable.

SUMMARY OF THE INVENTION

The objects herein have been accomplished by providing an electrical connector assembly, comprising an outer housing having at least one open wall, the outer housing being cooperable with alternative first and second inner housings; wherein the first inner housing has at least one contact receiving cavity and the first inner housing being profiled for positioning through the one open wall, the first inner housing has a locking latch axially positioned relative to the cavity, and is profiled to latch a contact when positioned therein. The second inner housing has at least one contact receiving cavity and the second inner housing is profiled for positioning through the one open wall, the inner housing having a locking shoulder axially positioned relative to the cavity, and profiled to receive a contact lance when the contact is positioned therein.

In another embodiment, a method of manufacturing an electrical connector assembly, comprises the steps of providing an outer housing having at least one open wall; providing a first inner housing having at least one contact receiving cavity where the first inner housing is profiled for positioning through the one open wall, the first inner housing having a locking latch axially positioned relative to the cavity, and profiled to latch a contact when positioned therein; providing a second inner housing having at least one contact receiving cavity and the second inner housing being profiled for positioning through the one open wall, the inner housing having a locking shoulder axially positioned relative to the cavity, and profiled to receive a contact locking lance when the contact is positioned therein; selecting either the first or second housing; and positioning the selected housing in the outer housing.

In yet another embodiment, an electrical connector assembly comprises an outer housing having at least one open wall, where one of the walls includes at least one alignment member; an inner housing has at least one contact receiving cavity and the first inner housing is profiled for positioning through the one open wall, leaving at least one wall of the inner housing exposed, and the exposed wall having at least one alignment member positioned thereon.

DETAILED DESCRIPTION OF THE DRAWINGS

Figure 1:
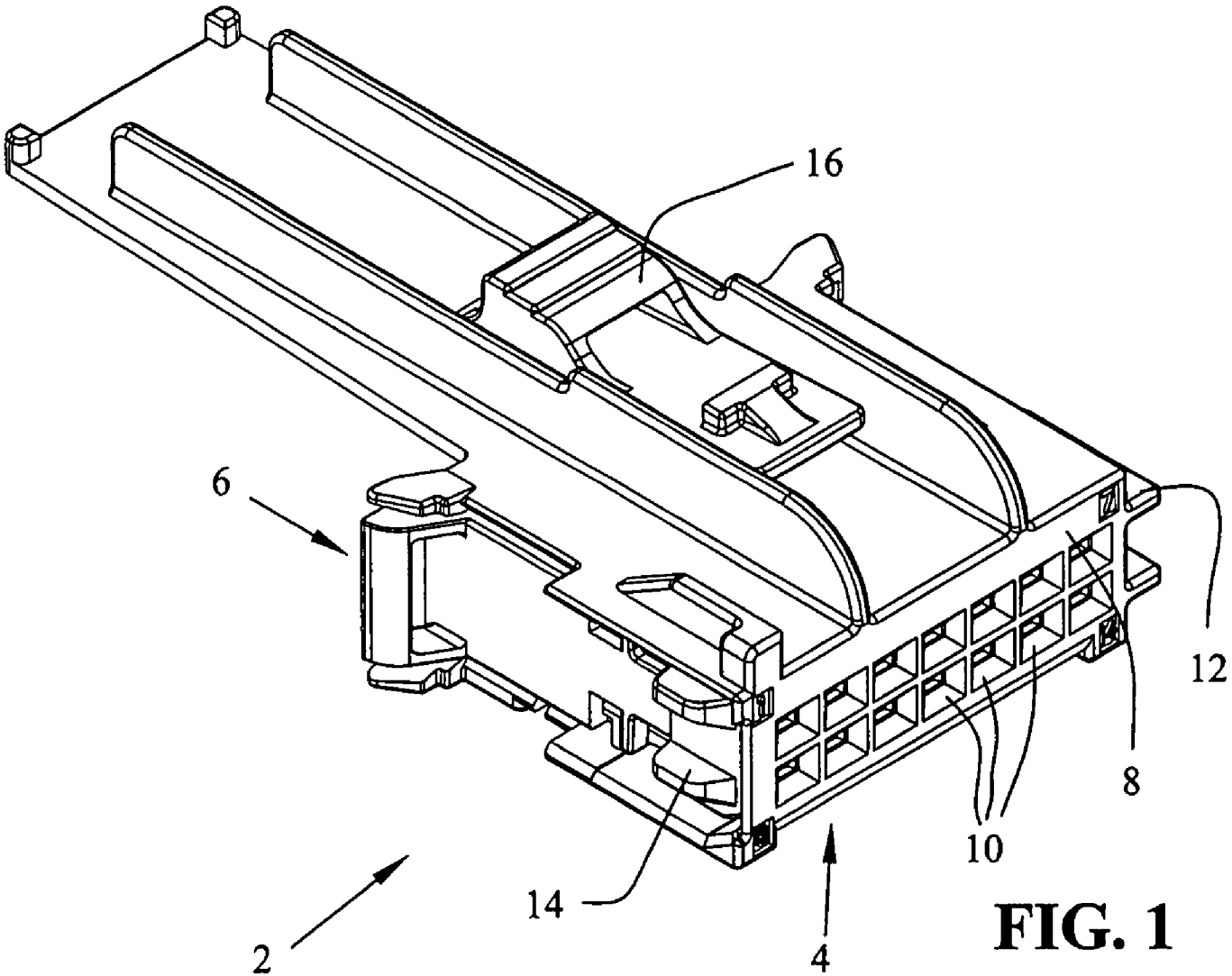
FIG. 1 shows a perspective view of the electrical connector assembly.

With reference first to FIG. 1, an electrical connector assembly is shown at 2 which is comprised of an outer housing 4 and an inner housing 6. Outer housing 4 is comprised of a front mating face 8 having a plurality of terminal receiving cavities 10 therethrough. Polarization with a mating connector is provided by alignment members 12 on the outer housing 4 and alignment members 14 on the inner housing 6. Retention of the connector assembly 2 is made by way of latch 16 as discussed further herein. With the general description of the electrical connector 2, the individual components will be described in greater detail.

Figure 4:
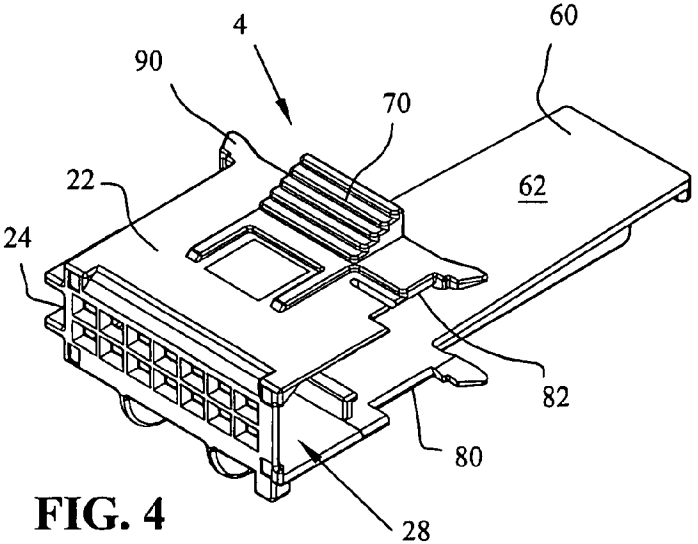
FIG. 4 shows a perspective view of the outer housing from the opposite side as that shown in FIG. 2.
Figure 2:
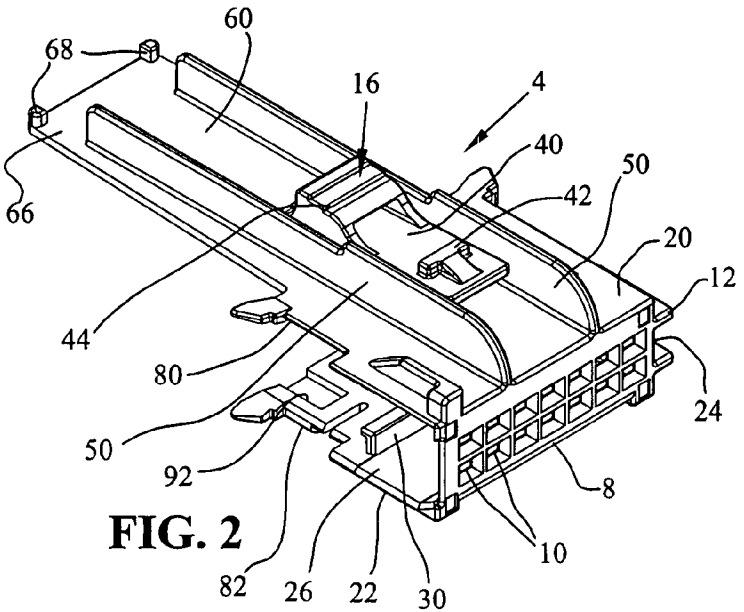
FIG. 2 shows a perspective view of the outer housing of the assembly shown in FIG. 1.
Figure 3:
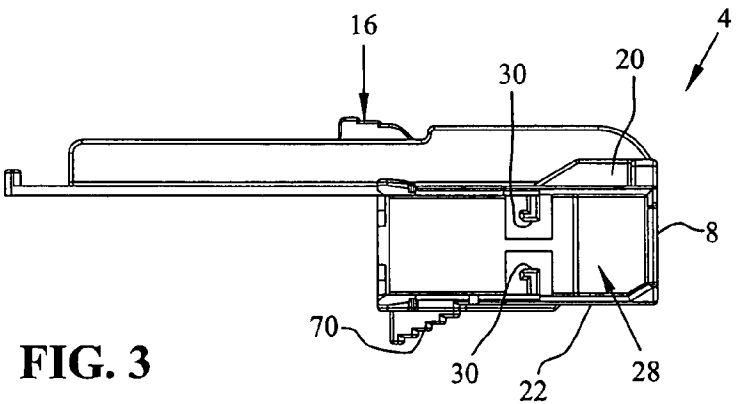
FIG. 3 shows a left-hand side view of the outer housing of FIG. 2.

With reference to FIGS. 2-4, outer housing 4 is shown as comprised of a top wall 20, bottom wall 22 and an end wall 24. An open wall is defined at 26 which defines an opening 28 into the interior of outer housing 4. L-shaped rails 30 extend from inside surfaces of the top and bottom walls 20, 22, which receive the inner housing 6 as described further herein. Latch 16 is generally comprised of a beam portion 40 having a locking lug at 42 and a finger or thumb grip 44 for depressing the latch as it is known in the art. Top wall 20 also includes two elongate alignment rails 50 which extend rearwardly from a position adjacent the mating face 8 and flank the latch 16. Top wall 20 extends rearwardly to define an extension portion 60 which provides a cable dress surface 62 (FIG. 4). A wire wrap slot 66 is defined between lugs 68 and a rearward end of rails 50.

With respect now to FIG. 4, bottom wall 22 includes a finger or thumb grip 70 which as shown in FIG. 3 may be used together with latch 16 for the user to grasp the latch and thumb grip 70 between the thumb and a finger or vice versa as it is known in the art. Finally, as best shown in FIGS. 2 and 4, top wall 20 includes a cutout portion 80 and bottom wall 22 includes a cutout portion 82 along the edges adjacent to opening 28. Outer housing 4 includes a handle portion 90 as an extension of end wall 24, and a locking shoulder 92 is provided on an internal surface of bottom wall 22.

Figure 5:
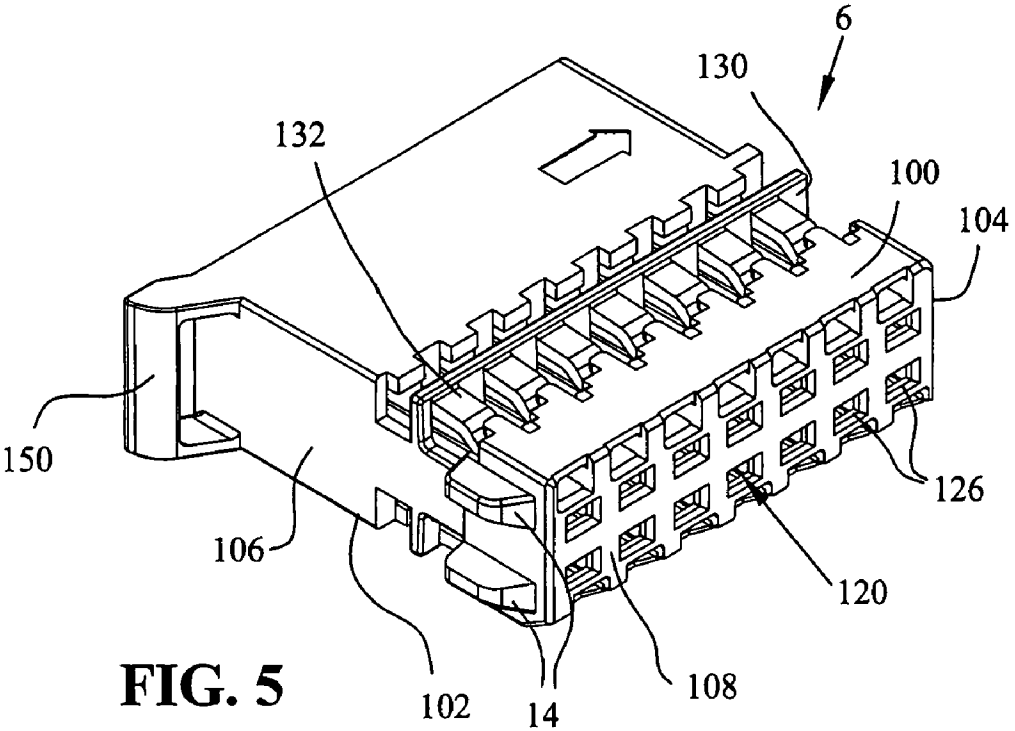
FIG. 5 shows an inner housing usable in the connector assembly of FIG. 1.
Figure 6:
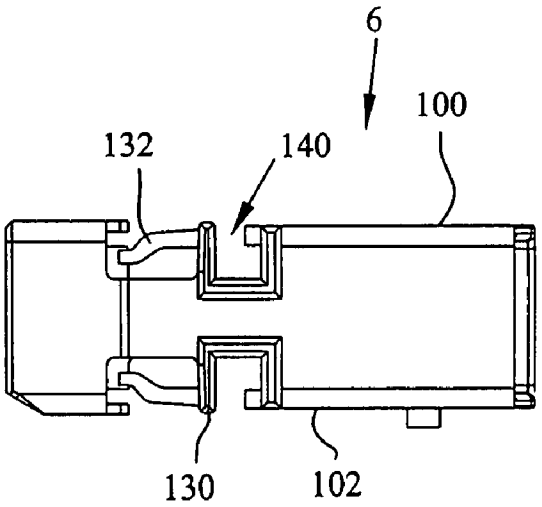
FIG. 6 is a side plan view of the inner housing of FIG. 5.
Figure 9:
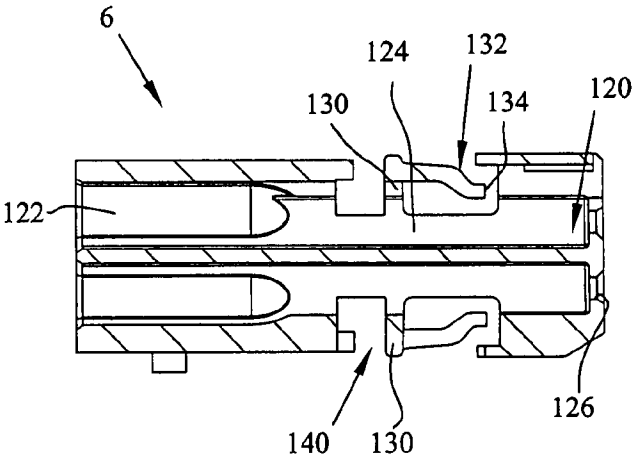
FIG. 9 shows a cross-sectional view through lines 9-9 of FIG. 8.
Figure 8:
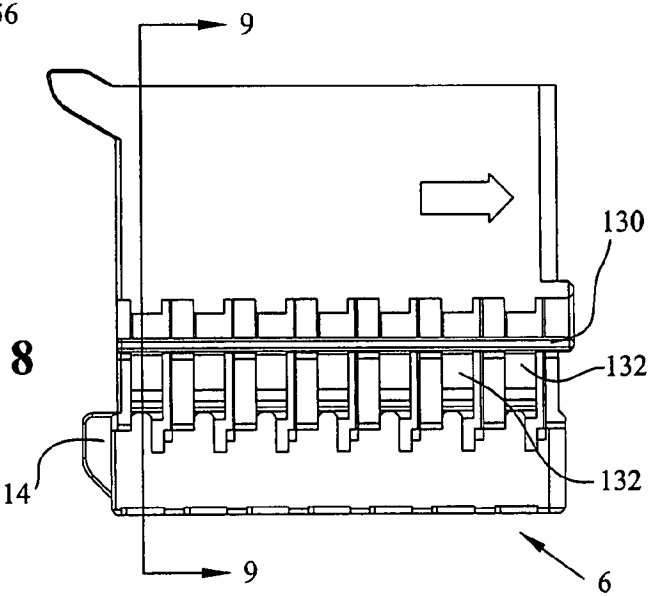
FIG. 8 shows a top plan view of the inner housing of FIG. 5.
Figure 7:
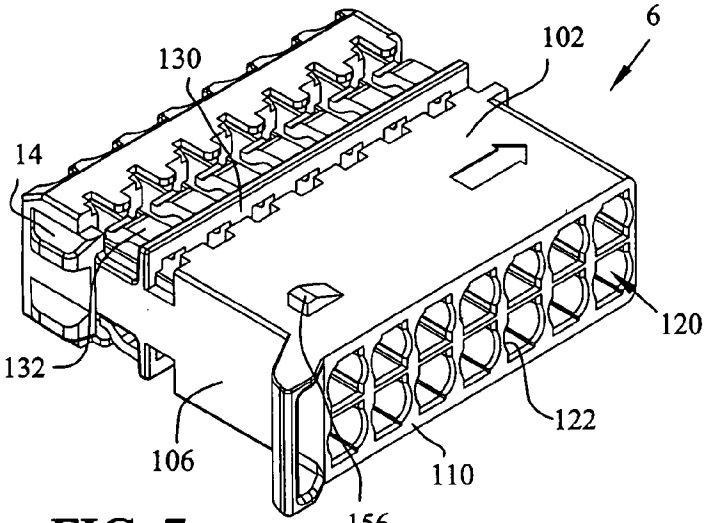
FIG. 7 shows a rear perspective view of the inner housing of FIG. 5.

With reference now to FIGS. 5-9, inner housing 6 will be described in greater detailed. With reference first to FIG. 5, inner housing 6 is comprised of a top wall 100, lower wall 102, end wall 104, end wall 106, front face 108 and rear face 110 (FIG. 7). A plurality of contact receiving cavities 120 extend through inner housing 6, and as best shown in FIG. 9, include a wire receiving opening at 122, a contact receiving area 124, and a mating contact receiving opening at 126. As shown best in FIGS. 5 and 9, a transverse wall 130 extends upwardly and laterally of the plurality of cavities 120 and includes a plurality of resilient locking latches 132 having locking shoulders 134 (FIG. 9). As best shown in FIGS. 6 and 9, L-shaped slots 140 are defined rearward of wall 130 and are profiled to receive the L-shaped rails 30 (FIGS. 2 and 3). Finally, a handle portion 150 (FIG. 5) extends from end wall 106 and a locking lug 156 (FIG. 7) is positioned on lower wall 102.

Figure 11:
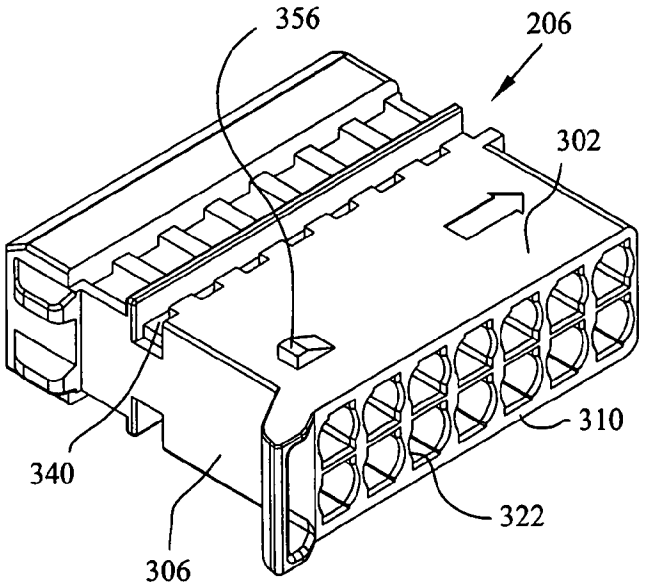
FIG. 11 shows a rear perspective view of the inner housing of FIG. 10.
Figure 10:
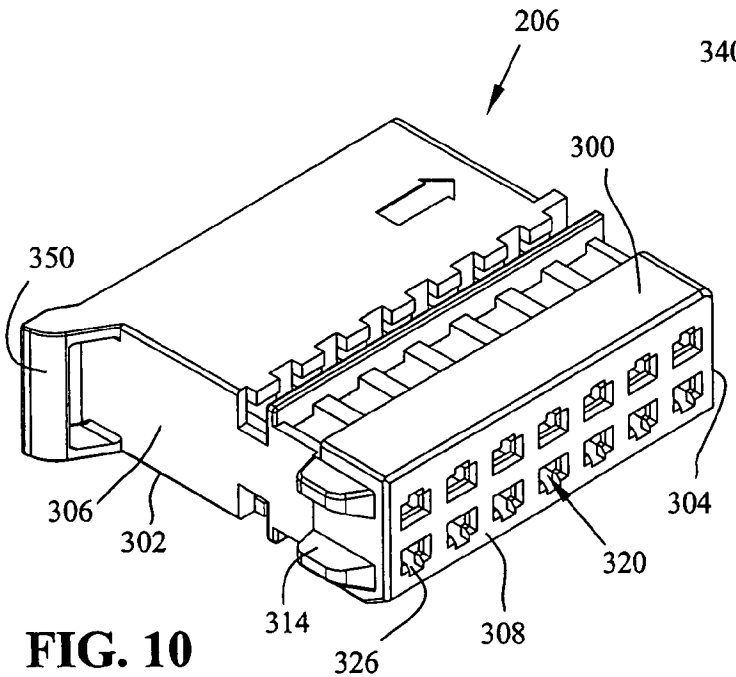
FIG. 10 shows another inner housing usable in the connector assembly of FIG. 1.
Figure 14:
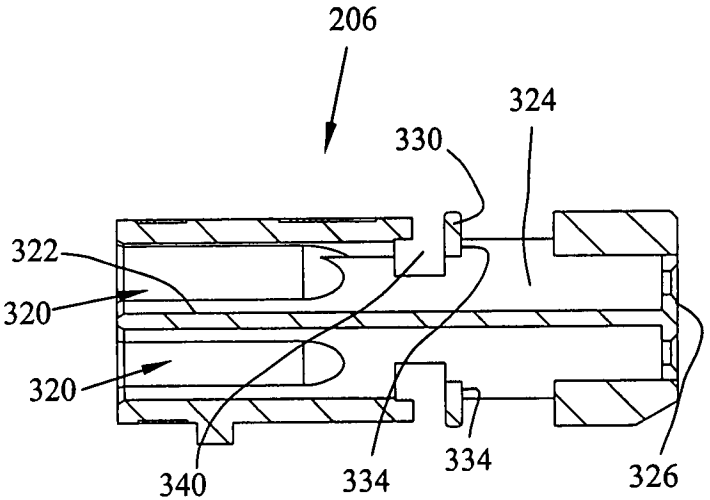
FIG. 14 shows a cross-sectional view through lines 14-14 of FIG. 13.
Figure 12:
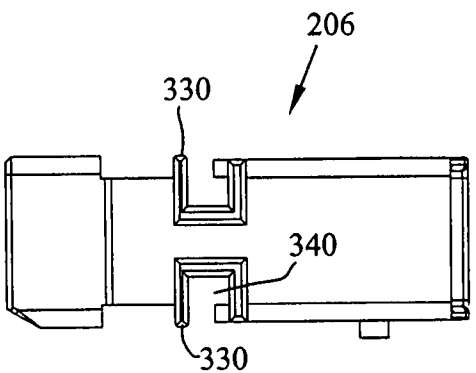
FIG. 12 shows a side plan view of the inner housing of FIGS. 10 and 11.
Figure 13:
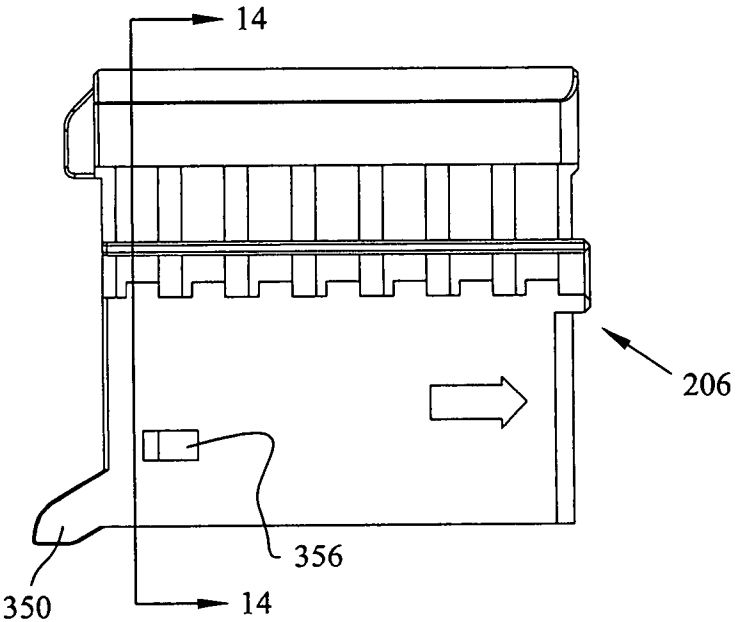
FIG. 13 shows a top plan view of the inner housing of FIGS. 10 and 11.

With reference now to FIGS. 10-14, inner housing 206 will be described in greater detailed. With reference first to FIG. 10, inner housing 206 is comprised of a top wall 300, lower wall 302, end wall 304, end wall 306, front face 308 and rear face 310 (FIG. 11). Alignment members 314 extend from end wall 306, as best shown in FIG. 10. A plurality of contact receiving cavities 320 extend through inner housing 206, and as best shown in FIG. 14, include a wire receiving opening at 322, a contact receiving area 324, and a mating contact receiving opening at 326. As shown best in FIGS. 12 and 14, a transverse wall 330 extends upwardly and laterally of the plurality of cavities 320 and define a plurality of locking shoulders 334 (FIG. 14). As best shown in FIGS. 12 and 14, L-shaped slots 340 are defined rearward of wall 330 and are profiled to receive L-shaped rails 30 (FIGS. 2 and 3). Finally, and as shown in FIG. 13, a handle portion 350 extends from end wall 306 and a locking lug 356 is positioned on top of wall 302.

Figure 15:
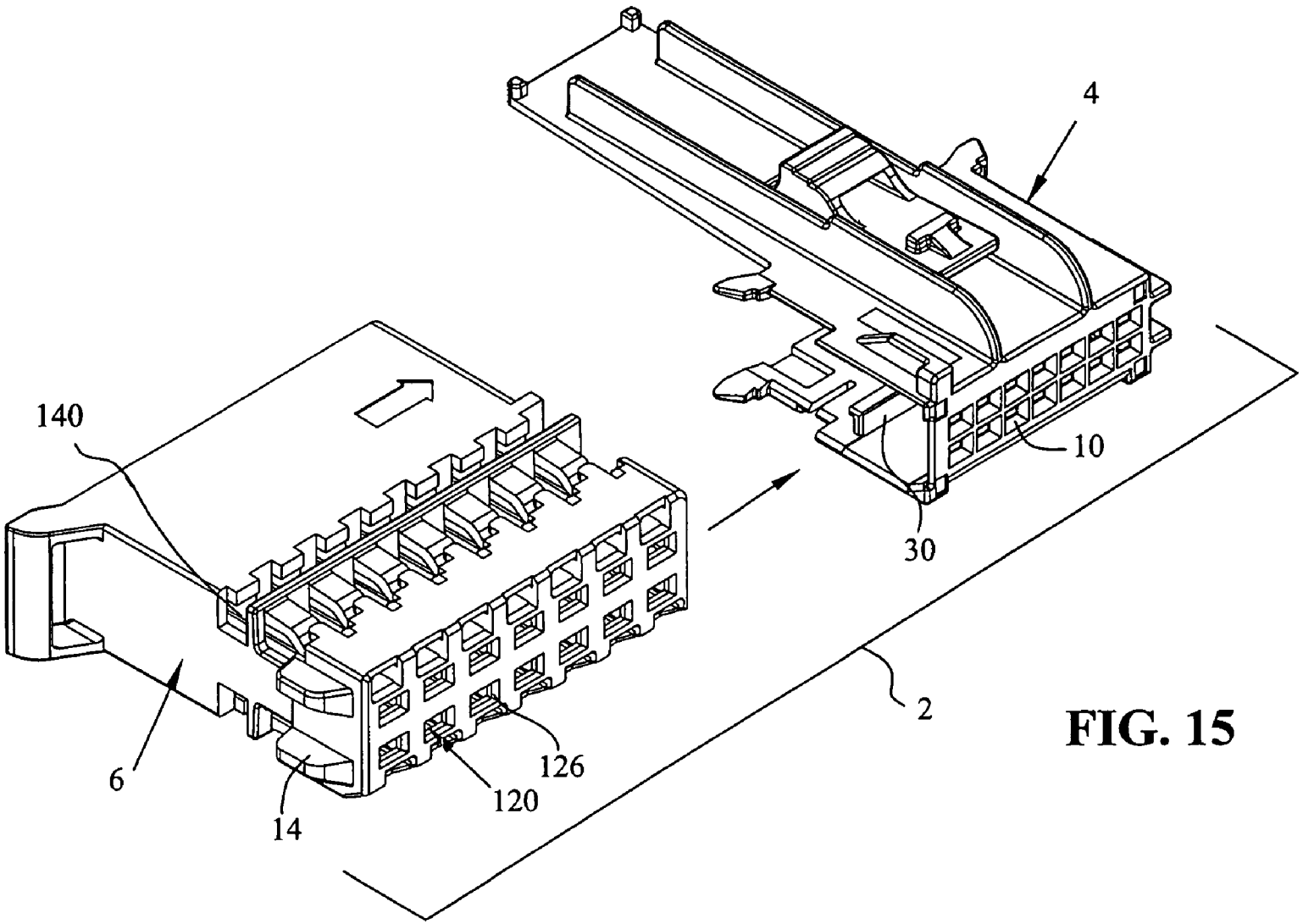
FIG. 15 shows a perspective view showing one of the inner housings poised for receipt within the outer housing.

With reference now to FIG. 15, the electrical connector assembly 2 may be assembled by sliding inner housing 6 into outer housing 4. This is accomplished by aligning L-shaped slots 140 with L-shaped rails 30 and moving the inner housing 6 in the direction of the arrow until such time as locking lug 156 (FIG. 7) interlocks with shoulder 92. This aligns apertures 10 with openings 126 and provides for an electrical connector assembly having a mating configuration including alignment members 12 and 14 positioned on opposite sides thereof, and a locking latch 16 for mating with a mating connector. In this connector assembly configuration, a clean body style contact may be received in cavities 120 and be slideably received until such time as a shoulder of the clean body contact is retained by shoulder 134 (FIG. 9).

Alternatively, alternate housing 206 may be used with the identical outer housing 4 where L-shaped slot 340 may be positioned in alignment with L-shaped rail 30 of outer housing 4 and be laterally received in outer housing 4 in the same manner as that described above with relation to inner housing 6 until such time as locking lug 356 is locked against shoulder 92 as described above. This aligns apertures 10 with openings 326 and provides for an electrical connector assembly having a mating configuration including alignment members 12 and 314 positioned on opposite sides thereof, and a locking latch 16 for mating with a mating connector. In this connector assembly configuration, a locking lance-style electrical contact may be received in cavities 320 and be slideably received until such time as a locking lance contacts shoulder 334 (FIG. 14) and is retained therein.

Thus, as shown, the same outer housing 4 may be used with alternate inner housings 6, 206, which can accommodate multiple styles of contacts. Two styles of contacts are shown herein, clean body and locking lance style, but other types could also be accommodated. Furthermore the mating profile of the electrical connector assembly 2 is provided by components (12, 14, 314) on both the inner 4 and outer 6 housings.

What is claimed is:

1. An electrical connector assembly, comprising:

an outer housing having at least one open wall, the outer housing being cooperable with alternative first and second inner housings; wherein the first inner housing having at least one contact receiving cavity and said first inner housing being profiled for positioning through one said one open wall, the first inner housing having a locking latch axially positioned relative to the cavity, and profiled to latch a contact when positioned therein; and the second inner housing having at least one contact receiving cavity and said second inner housing being profiled for positioning through said one open wall, the inner housing having a locking shoulder axially positioned relative to the cavity, and profiled to receive a contact lance when the contact is positioned therein.

2. The electrical connector of claim 1, wherein the outer housing is comprised of top and bottom walls, at least one end wall, and a front face.

3. The electrical connector of claim 2, wherein the open wall is provided opposite said one end wall.

4. The electrical connector of claim 1, wherein one of the walls of the outer housing comprises at least one alignment member and the inner housing, when positioned within the outer housing, has at least one wall exposed, said exposed wall having at least one alignment member positioned thereon.

5. The electrical connector of claim 4, wherein the outer housing is comprised of a top wall and a bottom wall with an end wall interconnecting the top wall and bottom wall, with the at least one alignment member positioned on said end wall.

6. The electrical connector of claim 5, wherein the inner housing is comprised of a top and bottom wall and two end walls, said inner housing being slidably receivable into said inner housing.

7. The electrical connector of claim 6, wherein the inner housing is slidable laterally.

8. The electrical connector of claim 4, wherein one of said end walls is exposed.

9. A method of manufacturing an electrical connector assembly, comprising the steps of:

providing an outer housing having at least one open wall;

providing a first inner housing having at least one contact receiving cavity and said first inner housing being profiled for positioning through one said one open wall, the first inner housing having a locking latch axially positioned relative to the cavity, and profiled to latch a contact shoulder when positioned therein;

providing a second inner housing having at least one contact receiving cavity and said second inner housing being profiled for positioning through one said one open wall, the inner housing having a locking shoulder axially positioned relative to the cavity, and profiled to receive a contact locking lance when the contact is positioned therein;

selecting either the first or second inner housing; and positioning said selected inner housing in said outer housing.

10. The method of claim 9, further comprising the step of providing a contact with a locking shoulder but without a locking lance and selecting said first inner housing.

11. The method of claim 9, further comprising the step of providing a contact with a locking lance, and selecting said second inner housing.

12. An electrical connector assembly for connection with a mating connector, comprising:

an outer housing having at least one open wall, where one of the walls includes at least one alignment member profiled for aligning the connector assembly with the mating connector;

an inner housing having at least one contact receiving cavity and said inner housing being profiled for positioning through said one open wall, leaving at least one wall of said inner housing exposed, said exposed wall having at least one alignment member positioned thereon profiled for aligning the connector assembly with the mating connector.

13. The electrical connector of claim 12, wherein the outer housing is comprised of a top wall and a bottom wall with an end wall interconnecting the top wall and bottom wall, with the at least one alignment member positioned on said end wall.

14. The electrical connector of claim 12, wherein the inner housing is comprised of a top and bottom wall and two end walls, said inner housing being slidably receivable into said inner housing.

15. The electrical connector of claim 14, wherein the inner housing is slidable laterally.

16. The electrical connector of claim 14, wherein one of said end walls of said inner housing is exposed, when positioned in said outer housing.

17. The electrical connector of claim 12, wherein the inner housing cavity is comprised of a resilient latch extending into the cavity for retaining a clean body contact.

18. The electrical connector of claim 12, wherein the inner housing is comprised of a locking shoulder axially positioned relative to the cavity, and profiled to receive a resilient contact lance when the contact is positioned therein.

* * * * *